United States Patent [19]

Bellem

[11] 4,348,846

[45] Sep. 14, 1982

[54] INSULATED ROOF

[75] Inventor: Norman A. Bellem, Kansas City, Mo.

[73] Assignee: Butler Manufacturing Company, Kansas City, Mo.

[21] Appl. No.: 193,003

[22] Filed: Oct. 2, 1980

[51] Int. Cl.[3] ..... E04B 1/76

[52] U.S. Cl. ..... 52/410; 52/478; 52/520; 52/528

[58] Field of Search ..... 52/404, 406, 407, 410, 52/478, 489, 520, 531, 545, 587, 105, 528

[56] References Cited

U.S. PATENT DOCUMENTS

| | | | |
|---|---|---|---|
| 1,900,346 | 3/1933 | Jarvis | 52/489 |
| 2,392,232 | 1/1946 | Crafton | 52/410 |
| 2,590,687 | 3/1952 | Crafton | 52/404 |
| 3,141,206 | 7/1964 | Stephens | 52/406 |
| 3,141,532 | 7/1964 | Runyan | 52/105 |
| 3,209,503 | 10/1965 | Mostoller | 52/404 |
| 3,290,845 | 12/1966 | Snyder | 52/404 |
| 3,399,503 | 9/1968 | Payne et al. | 52/406 |
| 4,213,282 | 7/1980 | Heckelsberg | 52/478 |

*Primary Examiner*—James L. Ridgill, Jr.
*Attorney, Agent, or Firm*—Shoemaker and Mattare, Ltd.

[57] ABSTRACT

An insulated roof includes a deck which acts as a diaphragm and a plurality of interlocked roof panels which carry vertical loads. A layer of insulation is also included, as are bearing plates.

14 Claims, 5 Drawing Figures

FIG. 2.
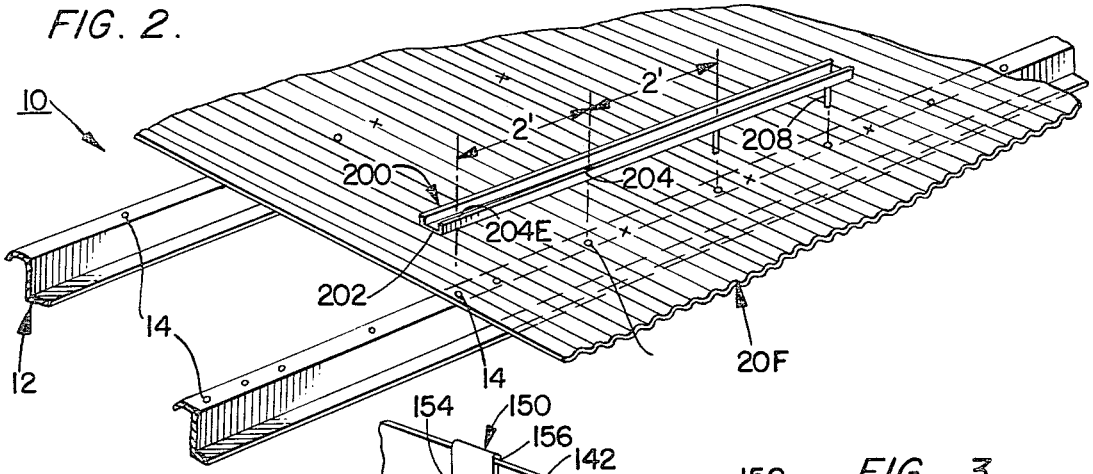
FIG. 3.
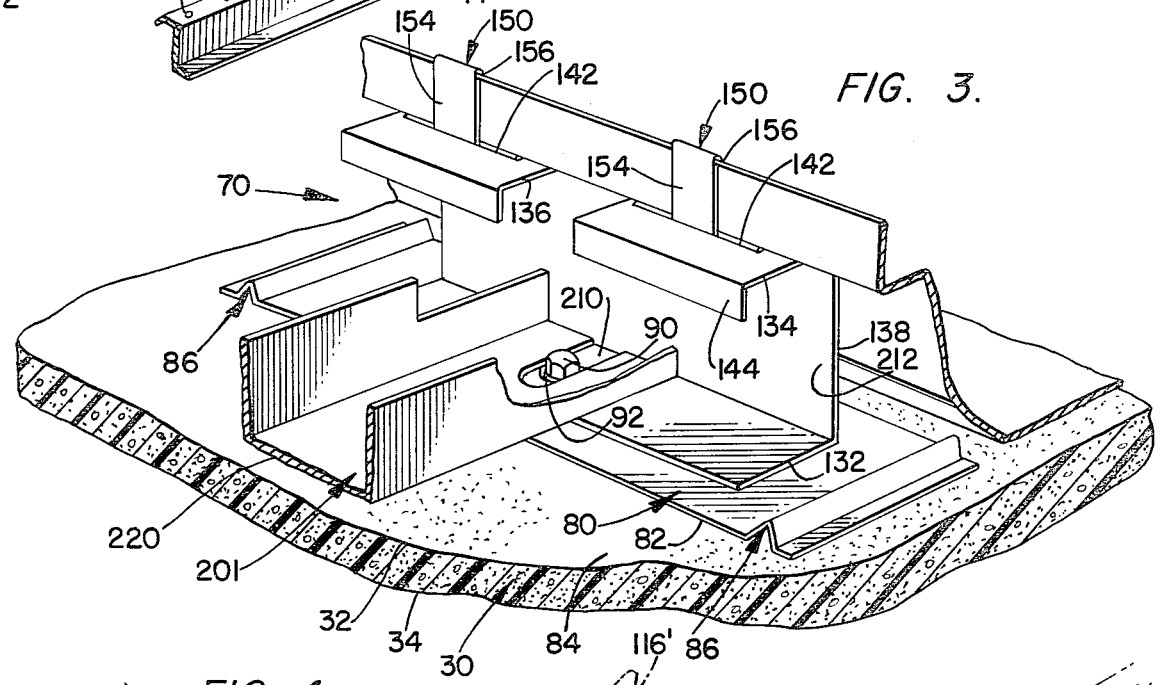
FIG. 4.
FIG. 5.
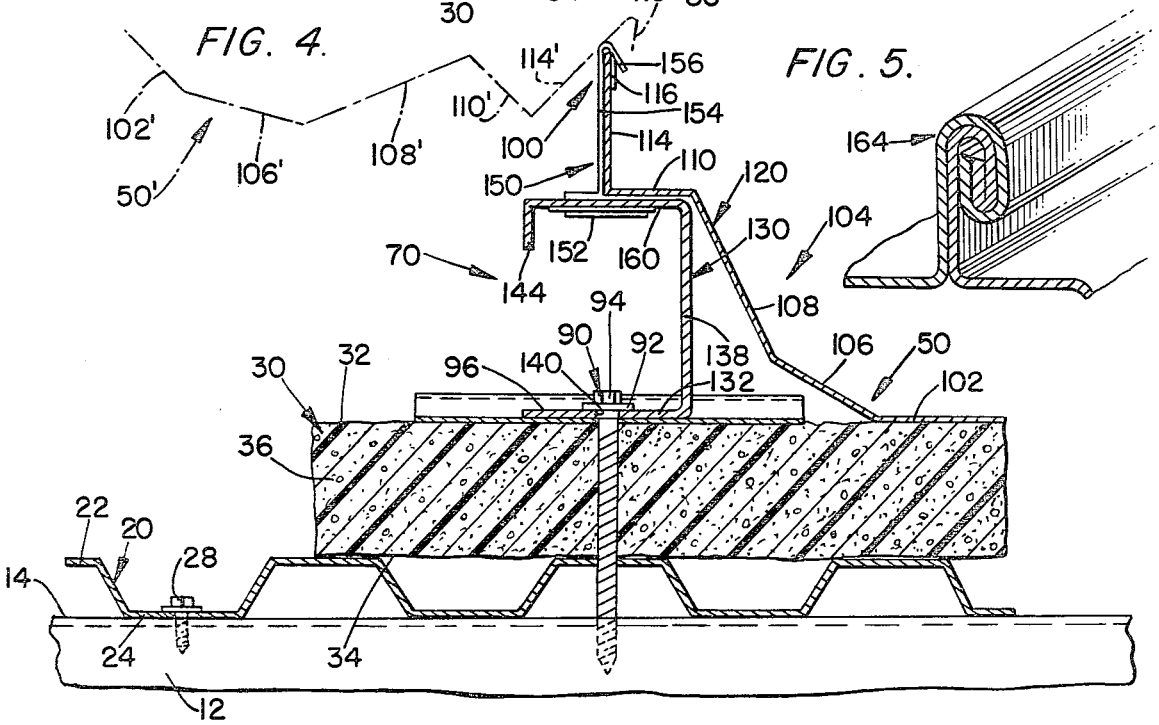

INSULATED ROOF

BACKGROUND OF THE INVENTION

The present invention relates in general to building structures, and, more particularly, to roof structures.

The assignee of the present application manufactures a roof sold under the name MR-24 (TM). This roof accommodates thermal expansion and contraction; however, does not adequately accommodate horizontal shear forces.

Other known roof structures are difficult to assemble, must be specially constructed, may have thermal short circuits and the like, in addition to not being able to adequately accommodate both thermal stresses and shear stresses.

SUMMARY OF THE INVENTION

The roof embodying the teachings of the present invention can be easily assembled from above, and accommodates stresses induced by temperature changes, vertical loads and horizontal loads.

The roof includes a corrugated deck mounted on building structural elements and a layer of insulation on top of the deck. The deck braces the building against horizontal loads due to wind loads.

The roof further includes a roof deck formed of a plurality of panels connected together and to the corrugated deck and to the building structural elements in a non-penetrating manner. Clip units and special edge crimping attach these roof panels together and to the building.

The clip units rest on bearing plates which distribute the loading of the roof panels so that the clip units will not endanger the insulation in the insulation layer.

The roof is assembled from above using a gauge to find the holes defined in the building structural elements at the factory. A special roof panel edge folding machine provided by the Butler Manufacturing Company can be used to couple the roof panels together and to the clip units.

Thus, the corrugated deck carries the shear forces generated by wind loads and the roof panels carry the vertical loads, such as snow or the like. Furthermore, the corrugated deck is stabilized by the insulation and the roof panel, thus synergistically increasing the diaphragm capability of the deck.

The roof embodying the teachings of the present invention has the following advantages:

(1) Roof erection can be entirely effected from above.

(2) The insulation of the insulation layer need not be notched or otherwise cut to accommodate the clips or the like, and thus, a large portion of any thermal short circuit is eliminated and no special cutting or the like is required.

(3) The clip units rest on bearing plates which distribute loading over a wide area, thereby safeguarding the insulation layer against rupture or tearing by the clip units.

(4) The roof is amenable to use with any deck, not just the corrugated deck disclosed herein as a preferred embodiment.

(5) The roof is amenable to use with any rigid insulation, not just the sandwich-type insulation disclosed herein as a preferred embodiment.

(6) The roof is amenable to use with any clip standing seam roof, not just the type of clip standing seam disclosed herein as a preferred embodiment.

(7) The roof of the present invention provides excellent U-values as compared to known roofs (e.g., 0.05 with $1\frac{3}{4}$ inch insulation).

(8) The presently disclosed roof is quick and easy to install.

(9) The interior appearance of a building using the presently disclosed roof is improved over known metal building roofs with faced insulation.

(10) The load bearing capacity of the presently disclosed roof is greatly increased over known roofs, thereby resulting in less deflection and walk-down than in such known roofs.

(11) The present roof has a significant diaphragm load bearing capacity.

(12) The roof of the present invention accommodates expansion and/or contraction and still provides lateral support for building structural elements, such as purlins or the like, and also provides a roof diaphragm.

OBJECTS OF THE INVENTION

It is the main object of the present invention to provide a roof which accommodates both thermal expansion and/or contraction and stresses induced by horizontal loads.

It is another object of the present invention to provide a roof which can be completely constructed from above.

It is another object of the present invention to provide a roof which has a minimum number of thermal short circuits.

It is yet another object of the present invention to provide a roof which accommodates both horizontal load induced stresses and vertical load induced stresses.

These together with other objects and advantages which will become subsequently apparent reside in the details of construction and operation as more fully hereinafter described and claimed, reference being had to the accompanying drawings forming part hereof, wherein like reference numerals refer to like parts throughout.

BRIEF DESCRIPTION OF THE DRAWINGS

FIG. 2 is a perspective view of a roof embodying the teachings of the present invention showing a method of erecting that roof.

FIG. 3 is a perspective view of a roof panel joint used in the roof embodying the teachings of the present invention.

FIG. 4 is a view taken along line 4—4 of FIG. 1.

FIG. 5 is a roof panel joint used in the roof embodying the teachings of the present invention.

DETAILED DESCRIPTION OF THE INVENTION

Figure 1:
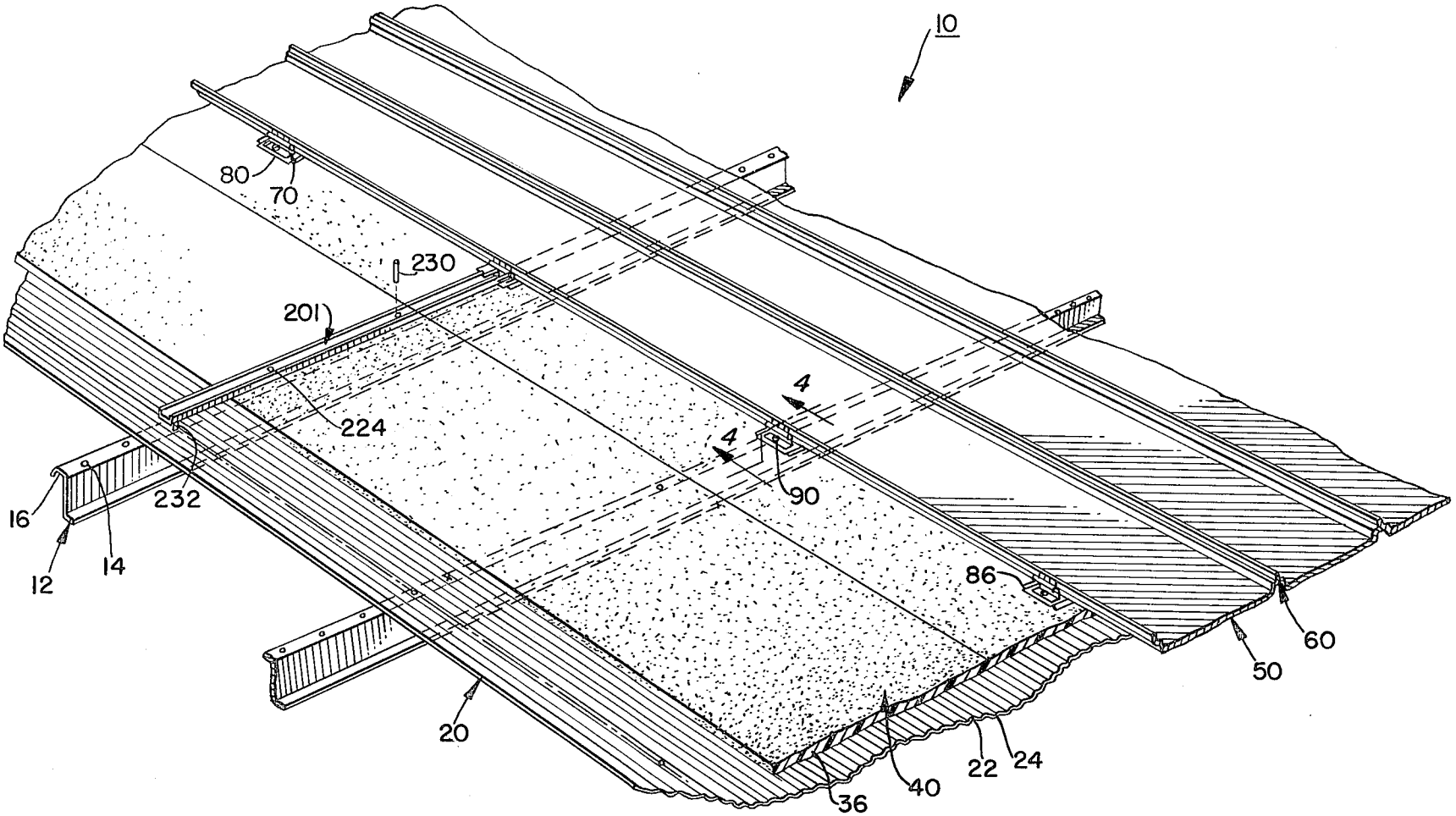
FIG. 1 is a perspective view of the roof embodying the teachings of the present invention.

Shown in FIGS. 1 and 2 is a roof 10 embodying the teachings of the present invention. The roof 10 includes building structural members, such as purlins 12 having factory set pre-punched fastener receiving holes 14 defined in a top flange 16 thereof. The purlins can be Z-shaped as shown in FIG. 1, or other suitable shapes.

The roof 10 further includes a corrugated roof deck 20 which has a multiplicity of peaks 22 and valleys 24 which have a longitudinal extent transverse to the purlins in the embodiment shown in FIG. 1. Fasteners, such as self-drilling metal screws 28, or the like, attach the roof deck panel members securely to the purlins.

A rigid insulating layer 30 covers the roof deck and has a pair of membranes 32 and 34 with insulation 36 sandwiched therebetween. The insulation layer rests on peaks 22 of the roof deck, and can include a plurality of panels 40.

The roof 10 further includes a plurality of interconnected roof panels 50 which are connected together by seams 60. A panel clip unit 70 is located subjacent each seam and rests on a bearing plate 80 which has a lower surface 82 resting on top surface 84 of top membrane 32. Each bearing plate is elongate and has a reinforcing ridge 86 near each end thereof. The reinforcing ridges act as stiffeners for the bearing plates and further prevent distortion of the bearing plate and movement of the bearing plate relative to the insulation.

A fastener, such as a self-tapping screw 90, attaches the clip unit to the bearing plate and to the roof deck and to the purlin, as best shown in FIG. 4. A washer 92, or the like, is a deformable material backed by a steel like material. The washer 92 is interposed between fastener head 94 and top surface 96 of the lower leg of the clip to be a thermal break and to be a means for limiting the amount of torque applied to the fastener. The amount of outward bulge produced in the washer deformable material visually indicates the amount of torque being applied to the fastener once the head and washer engage the clip unit. A predetermined amount of washer bulge indicates the desirable torque has been achieved.

A panel joint 100 is best shown in FIG. 4. Each panel includes a central planar section 102 and a stepped portion 104 on each longitudinal edge of the central portion. Each stepped portion includes first and second sloped planar portions 106 and 108 and a top planar portion 110 which is disposed to be in spaced parallelism with the central section. An upstanding planar portion 114 has an inwardly turned edge portion 116 connected thereto. The stepped portion of each panel 50 defines half of a housing 120 which accommodates a clip unit.

As best shown in FIGS. 3 and 4, each clip unit includes a C-shaped flange 130 having a base 132 and a pair of tops 134 and 136 and a bight section 138. A fastener receiving hole 140 is defined in the base 132 and an elongate slot 142 is defined in the tops to extend longitudinally of the unit. A front lip 144 depends from each top toward the base of the unit.

A panel tab 150 is located in each slot and includes a base 152, an upstanding body 154 and a hook 156. As best shown in FIG. 4, the bases 152 contact undersurface 160 of the clip tops, and the hooks 156 accommodate the inturned edge portion 116 of one panel. An adjoining panel 50' has inturned edge portion 116' thereof hooked over the tab hook to sandwich that hook between the two panel edge portions.

The thus connected panel portions with the hooks interposed therebetween are folded as shown to interconnect the adjoined panels at the edges thereof to form a double lock seam joint 164 as best shown in FIG. 5.

A suitable device for forming the joint 164 is known as a Roof Runner TM provided by Butler Manufacturing Company. The panels 50 are thus interconnected and attached to the building truss purlins without requiring penetration of such panels. Such non-penetrating coupling and fastening insures the integrity of the panels.

As above-discussed, the movable tab units permit the roof 10 to accommodate forces developed by thermal expansion and contraction, and the lower deck acts as a diaphragm to accommodate forces generated by wind loading on the building. The roof panels carry the vertically directed loads, such as snow or the like. Thus, roof 10 effectively accommodates both wind force generated loads and vertical loads. The roof 10 is thus both an effective diaphragm and vertical load bearing roof.

As shown in FIGS. 1 and 2, a gauge 200 is used after the deck panels are mounted on the purlins to locate the pre-punched holes 14, and a gauge 201 is used to locate those holes 14 after the insulation is mounted on the deck panels. The gauge 200 includes an elongate body 202 having a plurality of holes 204 defined therein to be spaced apart longitudinally of the body. The holes 204 are spaced apart distances corresponding to the spacing between the pre-punched holes 14 defined in the purlins. Aligning pins 208 are mounted on the gauge 200 to correspond to holes 204 and define fastener receiving holes 206 in the back panels and/or the insulation panels.

To use the gauge 200, a deck panel 20F is laid onto the purlins, and the gauge is aligned on a purlin by locating pin 208 in a pre-punched hole, then by using the holes in the gauge, such as hole 204E, the pre-punched holes 14 are located. The gauge is then laid on top of the deck panel, and the appropriate holes are defined in the deck panel using the rest of the gauge holes.

The gauge 201 includes an elongate body 220 having a plurality of holes 224 defined therein to be spaced apart longitudinally of the body. The holes 224 are spaced apart distances corresponding to the spacing between the holes 14 defined in the purlins. A hole defining means 230 fits through the holes 224 to be forced through the insulation thereby defining holes for clip attachment. An aligning pin 232 is mounted on the gauge to be fit into a hole 14 to thereby properly align and orient the gauge holes 224 with the pre-punched holes 14.

As shown in FIG. 3, an open-ended slot 210 is defined at the end of the gauge 201 which is opposite the aforementioned end containing the pin 232. The end containing slot is abutted against inner surface 212 of an in-place clip unit, and pre-punched holes 14 are located using the holes defined in gauge 201. The pin 232 thus aligns with a matching pre-punched hole through the deck hole which was located using gauge 200. Holes through the insulation can thus be defined using appropriate means. The clip unit and bearing plate can thus be precisely positioned with respect to the purlin holes 14. Once the holes are defined, the clip units and the like can be installed from above.

The entire roof 10, including the deck, the roof panels, the insulation layer, the clip units and bearing plates can be completely assembled from above, that is, by a workman standing on the purlins and the roof and the elements being assembled.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A building roof comprising:

a corrugated roof deck securely mounted on structural elements of a building;

a layer of rigid insulation on said roof deck layer;

a plurality of roof panels on said insulation and joined together by a joint which does not penetrate said roof panels;

a clip unit which includes a body, a bottom plate and a hook means joined to said roof panel joint, said hook means being movably connected to said body so that said joined roof panels are movably connected to said clip unit;

a bearing plate located between said clip unit bottom and the top of said insulation, said bearing plate having a surface area greater than the surface area of said clip unit bottom plate to distribute any force generated by said clip unit on said insulation over an area which is large compared to said clip unit bottom plate to protect said insulation from damage thereto caused by said clip unit;

fastening means securely connecting said clip unit, said bearing plate, said insulation and said roof deck to a building structural element so that said joined roof panels are movably mounted on the building structural element, said bearing plate permitting secure fastening of said clip units, said insulation and said roof deck to said structural elements without endangering said insulation;

said roof deck accommodating horizontally directed loading on a building and said movably mounted roof panels accommodating expansion and/or contraction of said joined rood panels, by reason of said insulation being securely positioned on top of said roof deck said roof deck horizontal load accommodating capability is increased by said insulation and roof panels over such capability of a roof deck alone.

2. The building roof defined in claim 1 wherein said bearing plate extends outwardly of all edges of the clip bottom plate.

3. The building roof defined in claim 1 wherein said bearing plate includes stiffening means.

4. The building roof defined in claim 1 wherein said rigid insulation includes insulation means sandwiched between a pair of outer membranes.

5. The building roof defined in claim 1 wherein said panel joint includes a double lock seam.

6. The building roof defined in claim 1 wherein said clip unit includes a slot defined in said body, and said hook is received in said slot and has a base on one end bearing against said body.

7. The building roof defined in claim 1 wherein said fastening means includes a means for defining a thermal break.

8. The building roof defined in claim 1 wherein the structural elements are pre-punched.

9. A method of erecting a roof comprising steps of:

pre-punching holes in building structural elements;

placing a corrugated deck on the building structural elements;

gauging the deck to identify the locations of the pre-punched holes in the building structural elements;

punching holes in the deck to correspond to the pre-punched holes;

placing a layer of rigid insulation on the deck;

gauging the layer of insulation to identify the locations of the pre-punched holes in the building structural elements;

punching holes in the insulation to correspond to the pre-punched holes;

placing a bearing plate on top of the insulation;

assemblying a clip unit to include a body, a bottom plate and a hook which is to be joined to roof panels and movably connecting the hook to the body so that a roof panel connected to the body by the hook is movable with respect to the body;

placing the clip unit on top of the bearing plate;

attaching the bearing plate, clip unit, insulation and deck to a building structural element;

tightening the clip and bearing plate securely against the insulation so the insulation is securely tightened against the roof deck so that the diaphragm capability of the roof deck and insulation is increased;

placing roof panels on the insulation; and interlocking the roof panels with the clip unit.

10. The method defined in claim 9 further including a step of attaching the roof deck to the building structural elements.

11. The method defined in claim 9 wherein the step of interlocking the roof panels includes forming a seam on the panels so the panels are interlocked in a non-penetrating manner.

12. The method defined in claim 11 wherein the clip unit has a tab and the seam is formed with the tab located between the interlocked panels.

13. The method defined in claim 12 including a step of defining a slot in the clip unit which accommodates the tab and permitting the roof panels to move with respect to the building structural elements.

14. A building roof comprising:

a corrugated roof deck securely mounted on structural elements of a building:

a layer of rigid insulation on said roof deck layer;

a plurality of roof panels on said insulation and joined together by a joint which does not penetrate said roof panels;

a clip unit which includes a body, a bottom plate and a hook means joined to said roof panel joint, said hook means being movably connected to said body so that said joined roof panels are movably connected to said clip unit;

a bearing plate located between said clip unit bottom and the top of said insulation;

fastening means securely connecting said clip unit, said bearing plate, said insulation and said roof deck to a building structural element so that said joined roof panels are movably mounted on the building structural element, said bearing plate permitting secure fastening of said clip units, said insulation and said roof deck to said structural elements without endangering said insulation;

said roof deck accommodating horizontally directed loading on a building and said movably mounted roof panels accommodating expansion and/or contraction of said joined roof panels, by reason of said insulation being securely positioned on top of said roof deck said roof deck horizontal load accommodating capability is increased by said insulation and roof panels over such capability of a roof deck alone.

* * * * *